US007300178B2

(12) United States Patent
Helou

(10) Patent No.: US 7,300,178 B2
(45) Date of Patent: Nov. 27, 2007

(54) DEVICE INTEGRATED INTO A CARD TO ACTIVATE AND/OR DEACTIVATE A LIGHT, SOUND OR LIGHT AND SOUND MODULE BY MEANS OF BLOWING

(76) Inventor: Nicolas Helou, 35, rue du Docteur Blanche, F-75016 Paris (FR)

( * ) Notice: Subject to any disclaimer, the term of this patent is extended or adjusted under 35 U.S.C. 154(b) by 234 days.

(21) Appl. No.: 10/954,129

(22) Filed: Sep. 29, 2004

(65) Prior Publication Data

US 2005/0090181 A1 Apr. 28, 2005

Related U.S. Application Data

(63) Continuation of application No. PCT/FR03/01915, filed on Jun. 23, 2003.

(30) Foreign Application Priority Data

Sep. 18, 2002 (FR) ..... 02 11570

(51) Int. Cl.
*F21V 33/00* (2006.01)

(52) U.S. Cl. ..... 362/253; 40/124.01; 40/124.02; 40/124.03; 40/439

(58) Field of Classification Search ..... 40/124.01, 40/124.02, 124.03, 439; 362/253, 183
See application file for complete search history.

(56) References Cited

U.S. PATENT DOCUMENTS 5,196,242 A * 3/1993 Vicino ..... 428/12
5,671,555 A 9/1997 Fernandes ..... 40/124.03
5,761,836 A 6/1998 Dawson ..... 40/124.03
5,852,889 A * 12/1998 Rinaldi ..... 40/124.06
6,068,118 A * 5/2000 Calloway ..... 206/233
6,098,325 A * 8/2000 Goldman ..... 40/495
6,966,840 B2 * 11/2005 Nelson ..... 472/56
2004/0150983 A1 * 8/2004 Sexton et al. ..... 362/84

FOREIGN PATENT DOCUMENTS

EP 0 070 653 A1 1/1983

* cited by examiner

*Primary Examiner*—Laura Tso
(74) *Attorney, Agent, or Firm*—DLA Piper US LLP

(57) ABSTRACT

A greeting card device which enables, by blowing, an LED to be switched off or a sound module (music, voice or noise) to be activated or deactivated, or a combination of a light and a sound to be activated or deactivated simultaneously. The device is composed of a bimetallic strip system, which the user blows on as if blowing out a candle, and which is connected to the integrated circuit of the LED or the sound module or both, as well as to a resistor and a capacitor which, by charging and discharging, allows switching on-switching off cycles to be repeated. The device according to the invention is particularly suited to the animation of greeting cards (birthdays, Christmas, etc.).

18 Claims, 2 Drawing Sheets

DEVICE INTEGRATED INTO A CARD TO ACTIVATE AND/OR DEACTIVATE A LIGHT, SOUND OR LIGHT AND SOUND MODULE BY MEANS OF BLOWING

RELATED APPLICATION

This is a continuation of International Application No. PCT/FR2003/001915, with an international filing date of Jun. 23, 2003 (WO 2004/011275 A1, published Feb. 5, 2004), which is based on French Patent Application No. 02/11570, filed Sep. 18, 2002.

TECHNICAL FIELD

This disclosure relates to a device that animates an open-out greeting card (birthdays, Christmas or the like and various messages).

SUMMARY

This disclosure relates to a device for animating an open-out greeting card including an electrical power source, a switch, a module and a system that is blown on by a user to activate and/or deactivate an integrated circuit which operates the module.

DETAILED DESCRIPTION

Figure 1:
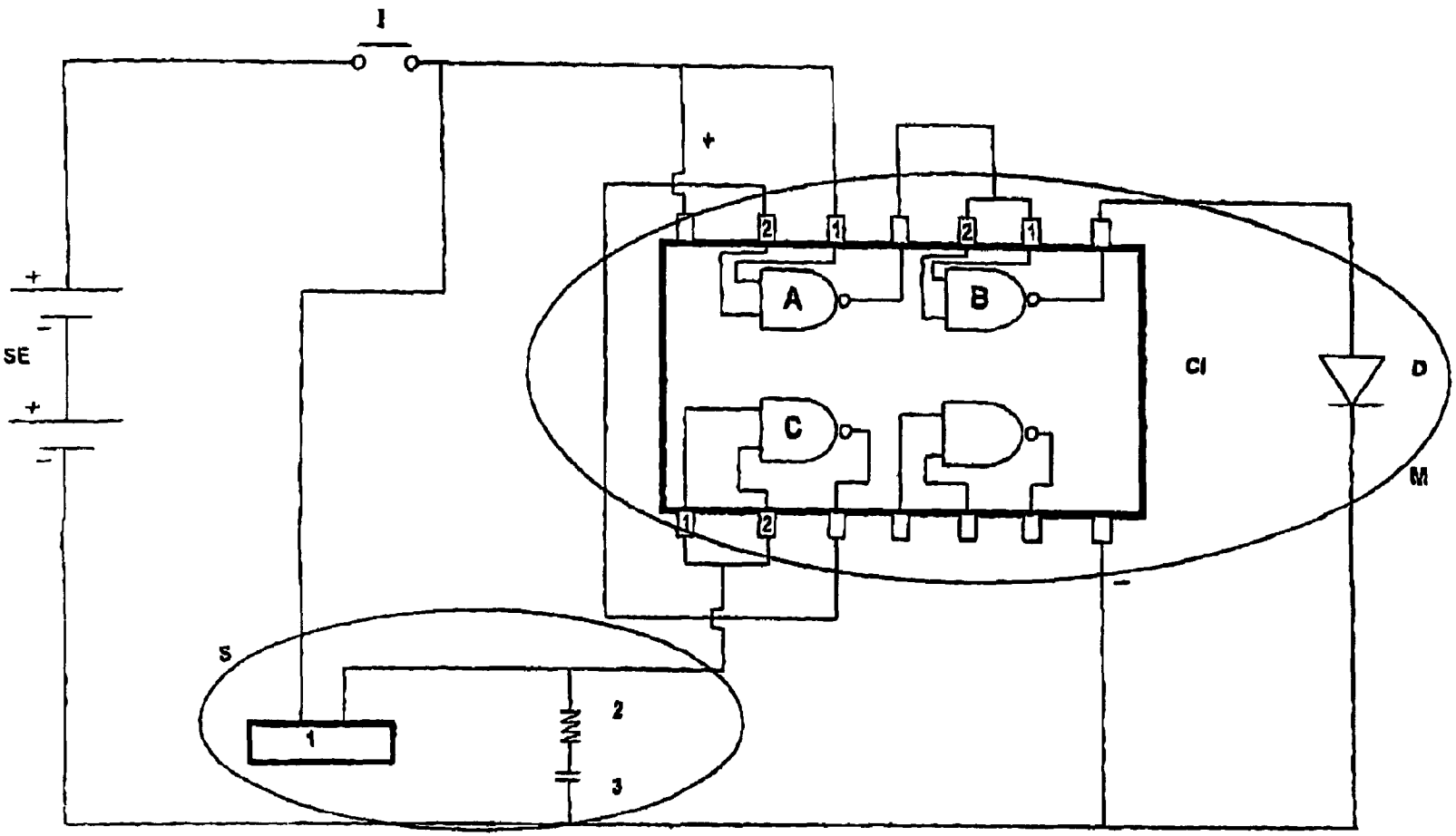
FIG. 1 is a circuit diagram of aspects of the invention.

As shown in FIG. 1, the device (50) comprises an electrical power source, for example, batteries or solar cells (SE), a switch (I), a module (M) and a system (S) which is to be blown on. The device also includes an animation module ("D" as shown in FIG. 1): LED, voice, sound, music or the like module, a system (S) which when blown on activates and/or deactivates the integrated circuit which operates a module.

The device comprises an electrical power source (SE), a switch (I), a module (M), and the system (S) formed by a bimetallic strip air sensor (1), a resistor (2) and a capacitor (3).

Figure 2:
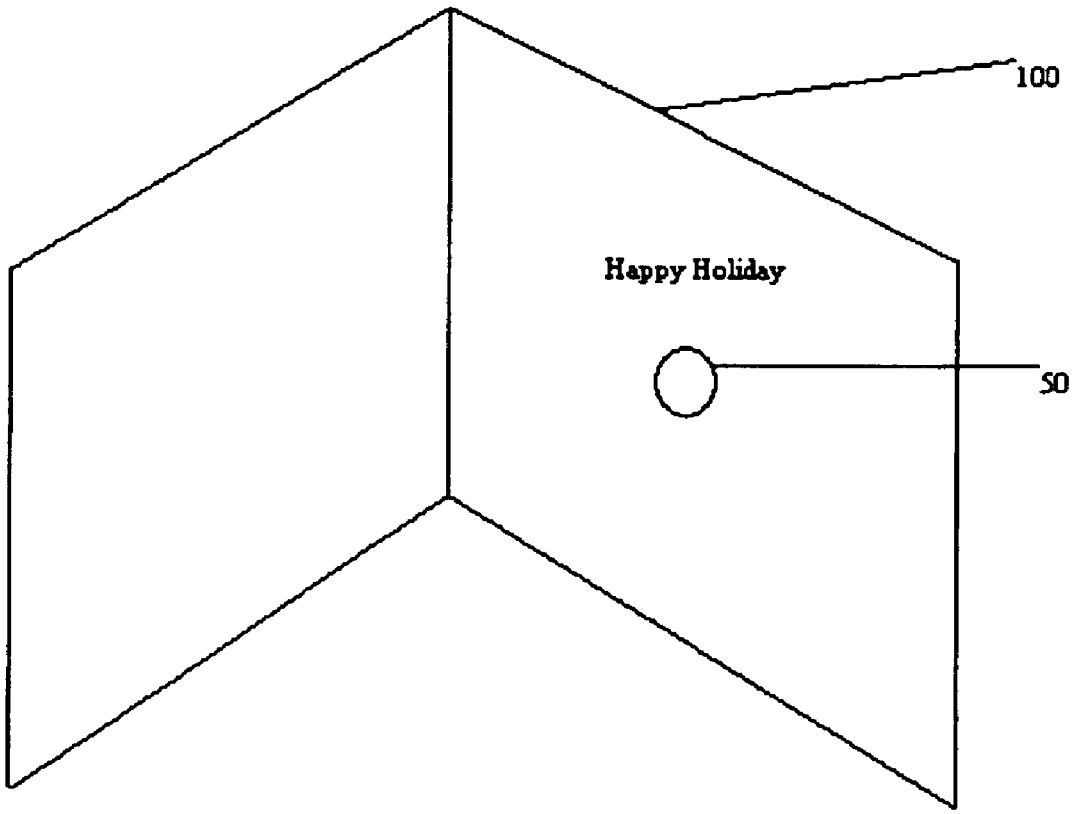
FIG. 2 is a schematic drawing of the device and a greeting card.

As shown in FIG. 2, the user opens the card (100) and the module starts to operate. The user blows on the air sensor (1), as if blowing out a candle, which is connected to the capacitor (3) which, by charging and discharging, via the resistor (2), allows the on/off cycles to be repeated.

According to selected aspects:

- the system can switch off, deactivate and reactivate a LED,
- the system can switch off a LED and simultaneously activate a sound module with a voice, a sound or music,
- the system can only activate and deactivate one sound module with a voice, a sound or music.

The device may include an energy source (SE) to which a switch (I) and an air sensor (1) are connected in parallel. The switch (I) is connected to an integrated circuit (CI). The air sensor (1) passes via a resistor (2) and a capacitor (3). The assembly which composes the system (S) is also connected to the integrated circuit. The integrated circuit (CI) is associated to an LED (D) in the module (M). The diode (D) captures the information output from the integrated circuit (CI).

One operating mode in accordance with aspects of the disclosure includes:

The card (100) opens, the card switch (I) powers the integrated circuit (CI) via the power supply (AL) and sends a logic signal to the first input of the NAN D A; there is a logic signal "0" at the two inputs of the NAND C (which acts as an inverter) which provides a "1" signal at its output.

This "1" signal is on the second output of the NAND A. This means that the NAND A output signal is 0.

This "0" signal is also found on the two NAND B inputs (which acts as an inverter).

The NAND B output is therefore "1"; the LED (D) operates.

The user blows, as if blowing out a candle, on a bimetallic strip system (1); this sends a "1" signal to the two NAND C inputs. This provides a "0" signal at its output, which is to be found on the second NAND A input; as the card stays open during the entire operation, the signal on the first NAND A input remains at "1". The NAND A output signal is then "1".

This "1" signal is to be found at the NAND B terminals, which provides "0" at the output, and the LED is switched off. However, during this operation, the capacitor (3) is charged via the resistor (2).

The user stops blowing, the air sensor sends a "0" signal, but as the capacitor is charged, it maintains the input signals at "1" until it discharges. The purpose of this is to keep the LED switched off. The discharge time is defined by the value of the resistor and the capacitor.

The capacitor is discharged. The NAND C input signal returns to "0", which provides a "1" signal at its output. As this "1" signal is found on the second NAND A input, (its first input is still at "1"), the NAND A gate has a "0" logic at its output, which gives a "1" logic at the NAND B output, and the LED is switched on again.

The value of the capacitor and the resistor depends on the time desired for the LED to be powered again. One example is:

Calculating the Resistance

T=CR; t=T/5

99%=5T

T=actual time=3 seconds.

For a time of 3 seconds and a capacitor of 1 μf

T=T/5; ⅗=0.6 s

R=t/C; 0.6/0.000001=600 kΩ

Test carried out for ⅘ seconds of extinction.

Resistance=461 KΩ

Capacitor=2.2 μf

Although the above structure has been described in connection with specific forms thereof, it will be appreciated that a wide variety of equivalents may be substituted for the specified elements described herein without departing from the spirit and scope of this disclosure as described in the appended claims.

The invention claimed is:

1. A device for animating an open-out greeting card comprising an electrical power source, a switch, a module and a system comprising a bimetallic strip air sensor that is blown on by a user to control an integrated circuit which operates the module, operatively connected together and collectively mounted on the greeting card.

2. The device according to claim 1, wherein the system comprises a resistor and a capacitor.

3. The device according to claim 1, wherein the module is formed by a LED connected to the integrated circuit.

4. The device according to claim 1, wherein the module is a sound device connected to the integrated circuit.

5. The device according to claim 1, wherein the module has a light and sound module.

6. The device according to claim 1, wherein the power source is batteries or solar cells.

7. An animation device for a greeting card comprising an electrical power source connected to a switch, a module and a system comprising a bimetallic strip air sensor which is blown on to control an integrated circuit which operates the module, collectively mounted on the greeting card.

8. The device according to claim 7, wherein the system comprises a resistor and a capacitor.

9. The device according to claim 7, wherein the module is formed by a LED connected to the integrated circuit.

10. The device according to claim 7, wherein the module is a sound device connected to the integrated circuit.

11. The device according to claim 7, wherein the module has a light and sound module.

12. The device according to claim 7, wherein the power source is batteries or solar cells.

13. A device for animating an open-out greeting card comprising an electrical power source, a switch connected to the power source, a module connected to the switch, and a system comprising a bimetallic strip air sensor connected to the module which is blown on to control an integrated circuit which operates the module.

14. The device according to claim 13, wherein the system comprises a resistor and a capacitor.

15. The device according to claim 13, wherein the module is formed by a LED connected to the integrated circuit.

16. The device according to claim 13, wherein the module is a sound device connected to the integrated circuit.

17. The device according to claim 13, wherein the module has a light and sound module.

18. The device according to claim 13, wherein the power source is batteries or solar cells.

* * * * *